US006037517A

United States Patent [19]

Wagner

[11] Patent Number: 6,037,517

[45] Date of Patent: Mar. 14, 2000

[54] APPARATUS AND METHOD FOR TREATING WASTE MATERIALS WHICH INCLUDE CHARGED PARTICLE EMITTERS

[75] Inventor: Anthony S. Wagner, Bee Caves, Tex.

[73] Assignee: Clean Technologies International Corporation, Bee Caves, Tex.

[21] Appl. No.: 09/186,227

[22] Filed: Nov. 4, 1998

[51] Int. Cl.[7] ..... G21F 9/30

[52] U.S. Cl. ..... 588/1; 588/201; 376/287; 250/515.1; 250/505.1; 422/159

[58] Field of Search ..... 588/1, 201; 976/DIG. 152, 976/DIG. 154, DIG. 162, DIG. 163; 376/287, 224, 422; 250/515.1, 516.1, 517.1, 518.1, 519.1; 219/759, 679

[56] References Cited

U.S. PATENT DOCUMENTS

| | | | |
|---|---|---|---|
| 4,263,163 | 4/1981 | Ross . | |
| 4,300,056 | 11/1981 | Gagneraud . | |
| 4,552,667 | 11/1985 | Shultz . | |
| 4,571,307 | 2/1986 | Bonniaud . | |
| 4,666,696 | 5/1987 | Shultz . | |
| 4,733,092 | 3/1988 | Jacobson | 250/515.1 |
| 5,000,101 | 3/1991 | Wagner . | |
| 5,167,919 | 12/1992 | Wagner . | |
| 5,424,042 | 6/1995 | Mason et al. | 422/159 |
| 5,525,408 | 6/1996 | Weir et al. | 428/220 |
| 5,640,702 | 6/1997 | Shultz . | |
| 5,678,236 | 10/1997 | Macedo et al. . | |
| 5,679,132 | 10/1997 | Rauenzahn et al. | 75/528 |
| 5,814,824 | 9/1998 | Hamby et al. . | |
| 5,866,095 | 2/1999 | McGeever et al. | 423/659 |

*Primary Examiner*—Steven P. Griffin
*Assistant Examiner*—Elin Warn
*Attorney, Agent, or Firm*—Shaffer & Culbertson, LLP; Russell D. Culbertson

[57] ABSTRACT

A reaction chamber (20) is charged with a reactant metal (18) which is heated to a molten state by a suitable heating arrangement (21). A field generating arrangement (17) generates a unidirectional electromagnetic field through the molten reactant metal (18) and through at least one target area preferably within the molten reactant metal. The electromagnetic field directs beta particles toward the first target area. A radiation absorbing module (15, 16) is positioned in the first target area and includes at least one radiation absorbing material (75, 76). The radiation absorbing material (75, 76) in the modules (15, 16) absorb the beta radiation which has been directed to the target area by the electromagnetic field.

17 Claims, 3 Drawing Sheets

APPARATUS AND METHOD FOR TREATING WASTE MATERIALS WHICH INCLUDE CHARGED PARTICLE EMITTERS

TECHNICAL FIELD OF THE INVENTION

This invention relates to waste treatment systems, and more particularly to an apparatus and method for treating waste materials which include beta radiation emitting constituents.

BACKGROUND OF THE INVENTION

Radioactive waste materials are generated at a number of different sources, including nuclear power plants, nuclear weapons facilities, and nuclear fuel processing facilities. There are also a number of less obvious sources of radioactive wastes. For example, the fly ash of coal power plants may include radioactive constituents. Also, radioactive materials are used in certain medical procedures. Thus, medical facilities are major producers of radioactive waste materials. The radioactive wastes produced at medical facilities include equipment and clothing which may be contaminated by the radioactive material used in medical procedures.

The three types of radiation emitted from radioactive materials are alpha, beta, and gamma radiation. Alpha and beta radiation comprise particles which are emitted from the nucleus of an atom, while gamma radiation comprises short-wavelength photons of nuclear origin. Alpha particles are doubly ionized helium nuclei, and thus have a net positive electrical charge. Beta radiation comprises primarily electrons, although some radioactive isotopes emit positrons which are also referred to as beta particles. Both the charged alpha particles and beta particles may be deflected by an electromagnetic field, although beta particles are deflected more easily due to their lower mass. Gamma radiation is either emitted from a radioactive material directly or emitted as the result of a collision between an alpha or beta radiation particle and some other particle.

Radioactive materials may emit one or more of the three different types of radiation, alpha, beta, of gamma radiation. Many radioactive materials emit primarily only alpha particles and/or beta particles, but produce gamma radiation indirectly as the high-energy alpha and beta particles collide with other particles.

Wastes which include radioactive materials may be treated in a molten metal process to remove organic materials and to tie up the radioactive material. U.S. patent application Ser. No. 09/096,617, filed Jun. 12, 1998 by the present inventor, discloses an apparatus and method for treating waste streams which include radioactive constituents. The apparatus and method disclosed in Application Ser. No. 09/096,617, which is incorporated herein by reference, removes organic constituents from the mixed waste stream and contains the radioactive constituents. Organic materials in the waste stream react with the molten reactant metal to produce primarily elemental carbon, hydrogen, nitrogen, and metal salts. Radioactive materials in the waste stream are alloyed in the molten metal for eventual storage. The molten metal process disclosed in Application Ser. No. 09/096,617, utilizes radiation absorbing metals such as lead and tungsten, for example, in the molten reactant metal in order to safely absorb radioactive emissions from the alloyed radioactive materials.

SUMMARY OF THE INVENTION

It is an object of the invention to provide an apparatus and method for treating wastes which include radioactive constituents, particularly beta radiation emitters.

The apparatus according to the invention includes a molten metal reactor and an electromagnetic field generating arrangement. The molten metal in the reactor reacts with any organic constituents in the waste material, and alloys the radioactive constituents. The electromagnetic field generating arrangement produces a unidirectional electromagnetic field extending through the molten metal and through at least one target area preferably within the molten metal. This unidirectional electromagnetic field directs or deflects beta radiation toward the target area and into a replaceable radiation absorbing module positioned in the target area. It is also believed that the intense electromagnetic field may enhance the beta emissions. In any event, radiation absorbing material included in the module absorbs the beta radiation in a stable form. The radiation absorbing material in the module also absorbs gamma radiation produced as beta particles and alpha particles are absorbed by the radiation absorbing material.

The molten metal reactor includes a reactor chamber charged with a suitable reactant metal. A heating arrangement is included in the molten metal reactor for heating the reactant metal and maintaining the reactant metal in a molten state at a desired reaction temperature. A waste input structure is preferably included for introducing the waste material into the reactor in position for a submerging arrangement to submerge the material in the molten reactant metal. A circulating arrangement may be included for circulating the molten metal within the reaction vessel and ensuring that the radioactive constituents circulate through the area of the molten metal traversed by the electromagnetic field. The preferred molten metal reactor also includes an arrangement for removing reaction products from the molten metal reactor and also an arrangement for adding additional reactant metal.

The reactant metal used in the molten metal reactor may comprise any suitable reactant metal. The primary constituent of the reactant metal preferably comprises aluminum although magnesium and/or lithium may be used with or instead of aluminum. In one preferred form of the invention, the molten metal comprises primarily aluminum along with lesser fractions of other constituents such as iron, copper, zinc, and calcium, for example. The reactant metal also preferably includes one or more radiation absorbing metals such as lead, tungsten, palladium, cadmium, dysprosium, and europium.

The electromagnetic field generating arrangement comprises at least one coil of electrically conductive material. The coil or coils are preferably located within the molten metal in position to produce a highly focused electromagnetic filed in at least one target area. Each coil is encased within a protective material to protect the coil material from reacting or alloying with the molten metal. In the preferred form of invention, each coil is made from a tubular conductor material such as copper. The invention includes a cooling system comprising a coolant fluid supply and pump for circulating the coolant fluid through each tubular conductor and cooling the conductor material. A heat exchanger may be used for cooling the coolant fluid prior to returning the fluid to the coolant supply.

The electromagnetic field produced through the molten reactant metal according to the invention is unidirectional, that is, the field does not alternate directions. The direction of the field is such that it directs beta particles to the target area or areas and thus to the radiation absorbing modules positioned in each target area. The field generating arrangement includes a voltage supply for inducing a current through each coil to produce the desired field. In the preferred form of the invention the voltage is pulsed to produce a pulsed unidirectional electromagnetic field. The pulsed electromagnetic field creates a pumping or circulating action within the molten reactant metal.

Each radiation absorbing module includes a material suitable for absorbing the radiation which is directed to the target area by the electromagnetic field. In the preferred form of the invention, each module includes alternating layers of tungsten and lead with a spacing arrangement to maintain the spacing between tungsten layers. The spacing arrangement may comprise tungsten spacer extensions formed on each tungsten layer. In any case, all of the radiation absorbing material in each module is preferably encased in a protective material. The protective material protects the radiation absorbing material so that the module may be positioned in contact with the molten reactant metal without losing the radiation absorbing metals to the melt.

In the preferred form of invention, one radiation absorbing module is mounted on a positioning structure which allows the module to be positioned in a target area within the molten reactant metal. The preferred target area is an area at which the electromagnetic field strength is greatest. One or more additional radiation absorbing modules may also be positioned in different target areas traversed by the electromagnetic field.

The apparatus according to the invention directs beta radiation emissions from radioactive waste materials in the molten reactant metal to the replaceable radiation absorbing modules. Thus, beta radiation may be absorbed in the module without allowing the radioactive materials to commingle and alloy with the radiation absorbing material of the module. Absorbing the beta radiation with these replaceable, isolated modules effectively increases the capacity of the system to handle beta emitting materials without increasing the volume of the reactant metal, and thus the volume of material which is then contaminated with the radioactive material.

These and other objects, advantages, and features of the invention will be apparent from the following description of the preferred embodiments, considered along with the accompanying drawings.

DESCRIPTION OF THE PREFERRED EMBODIMENTS

Figure 1:
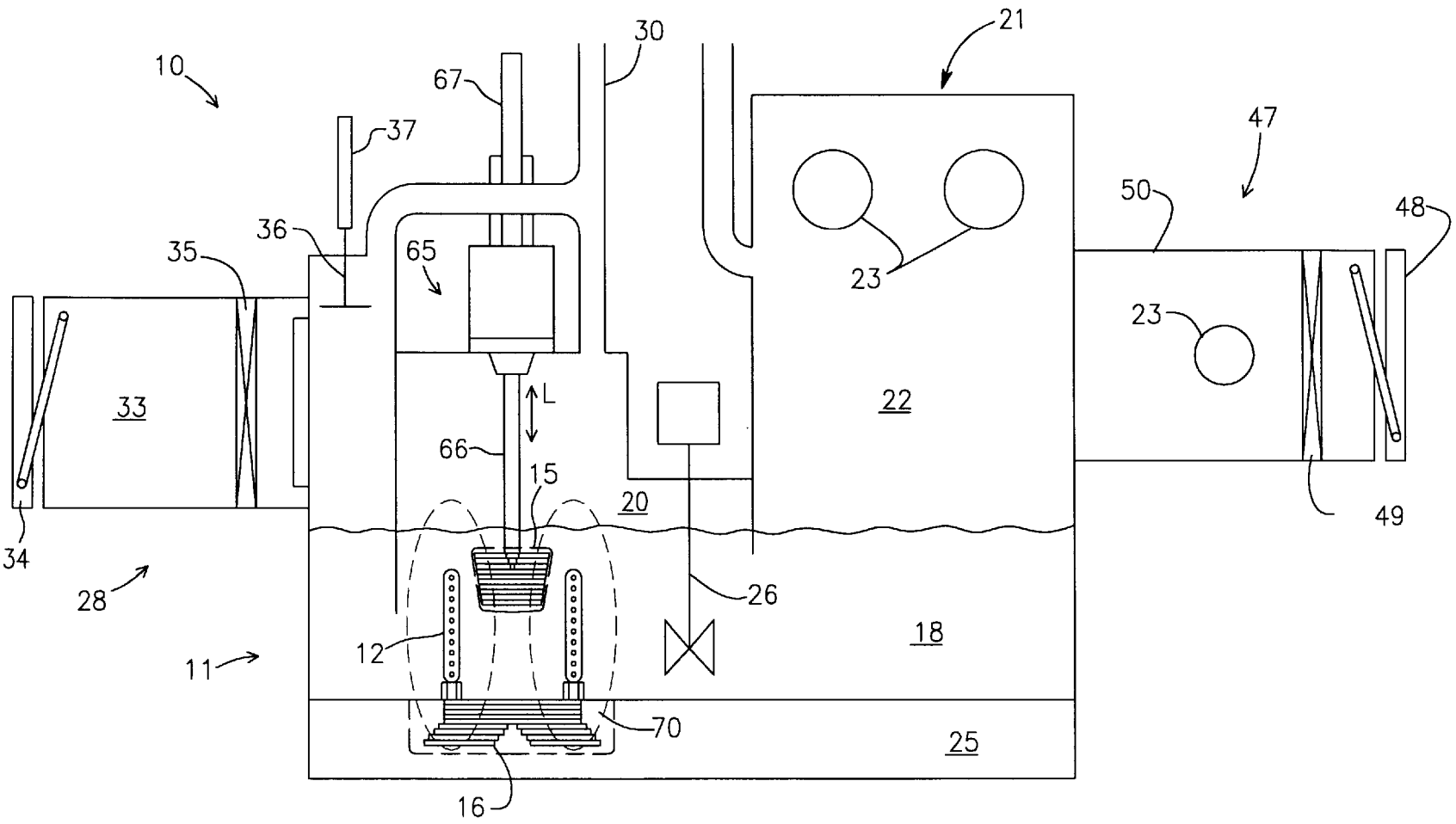
FIG. 1 is a diagrammatic representation of a waste treatment apparatus embodying the principles of the invention.

Referring to FIG. 1 a waste treatment apparatus 10 includes a molten metal reactor 11 and an electromagnetic field generating arrangement including secondary coil 12. The waste treatment apparatus 10 also includes at least one radiation absorbing module. FIG. 1 shows a form of the invention having a first radiation absorbing module 15 and a second radiation absorbing module 16. As will be discussed in detail below with reference to FIGS. 2 and 3, the field generating arrangement 17 including coil 12 produces a unidirectional electromagnetic field extending through the reactant metal 18 in the molten metal reactor and target areas in which radiation absorbing modules 15 and 16 are located. The electromagnetic field directs or deflects beta particles toward the radiation absorbing modules 15 and 16, and particularly the first module 15.

Molten metal reactor 11 includes a reaction chamber 20 having a suitable vessel for containing molten reactant metal 18. Reactor chamber 20, and particularly the reactant metal containment vessel associated therewith, preferably has a generally circular shape. Reactor 11 also includes a drain arrangement (not shown) by which molten metal from the reactor may be drained to form ingots. As set out in U.S. patent application Ser. No. 09/096,617, the ingots serve to encapsulate the radioactive waste materials which collect in the molten reactant metal.

Reactor 11 also includes a heating arrangement 21 for heating the reactant metal 18 to the molten state and maintaining the reactant metal in the molten state in a desired reaction temperature range between around 800 degrees Celsius to around 900 degrees Celsius. Heating arrangement 21 includes a heating chamber 22 and burners 23. Although the illustrated form of invention shown in FIG. 1 includes gas-fired heaters, those skilled in the art will readily appreciate that any suitable heating devices may be employed for heating the reactant metal and maintaining the reactant metal in the desired molten state. In any event, molten metal reactor 11 also preferably includes a circulating arrangement including stirrer 26 for circulating the molten reactant metal 18 within reaction chamber 20 and between the reaction chamber and heating chamber 22. The preferred circular shape of the reaction chamber 20 facilitates good molten metal circulation throughout the chamber. Also, both chambers 20 and 22 are sealed to isolate the molten reactant metal 18 from oxygen, and the reactor may include a purging system (not shown) for purging the reactor of air prior to operation.

All of the components of the reactor 11 shown in FIG. 1, including the reaction and heating chambers 20 and 22, respectively, may be made from any suitable material which maintains sufficient strength at the operating temperatures of the reactor. All metals which come in contact with the molten reactant metal 18 are coated with a suitable ceramic or other protective material (not generally shown in the figures) for protecting the metal from the molten reactant metal. Any suitable protective material, such as a fused silicate for example, may be used for protecting metals in the apparatus 10 which may be exposed to the reactant metal 18. The bottom of reaction chamber 20 and the associated heating chamber 22 is preferably lined with a thick layer 25 of alumina bricks.

Molten metal reactor 11 also preferably includes a waste material input arrangement 28 for introducing waste materials into the reaction chamber 20, and a reaction product recovery arrangement, including a reaction chamber vent 30, for recovering reaction products from the reactor. As shown in FIG. 1, input arrangement 28 includes an input chamber 33 with an exterior air lock door 34 and an interior air lock door 35. Waste material (not shown) is first loaded into the input chamber 33 through the exterior door 34 and then the exterior door is closed. Interior door 35 may then be opened to introduce the waste material into reaction chamber 20. Once the waste material is introduced into reaction chamber 20, a dunking or submerging member 36 may be advanced downwardly by a suitable actuator 37 to submerge the waste material into the molten reactant metal 18.

Those skilled and the art will readily appreciate that the waste material input arrangement 28, illustrated diagrammatically in FIG. 1, is shown simply for purposes of describing the invention. Many alternative arrangements may be employed for introducing waste material into reaction chamber 20 while minimizing the introduction of oxygen into the reaction chamber. Alternative arrangements which introduce waste materials in discrete batches such as the illustrated arrangement, as well as continuous waste material introducing arrangements, are well within the scope of those skilled in the art and are to be considered equivalents to the input arrangement 28 shown in the FIG. 1.

A large fraction of the reaction products produced by the molten metal reactor 11 are removed from the reactor through reaction chamber vent 30. Organic materials included in the waste materials introduced into reaction chamber 20 react with the molten reactant metal 18 to produce gaseous carbon, elemental gases such as hydrogen and nitrogen, and metal salts which may be an either solid or gaseous form. All of the gaseous products including gaseous carbon, hydrogen, nitrogen, and gaseous metal salts exit reaction chamber 20 through the reaction chamber vent 30. Although not shown in FIG. 1, the gaseous reaction products may be passed through an aqueous scrubber to produce a metal salt solution containing carbon particles. The carbon particles may then be removed from the salt solution by a suitable solids separator and then the water evaporated from the salt solution to recover the metal salts.

Solid reaction products produced in the reaction between waste material constituents and reactant metal 18 segregates to the surface of the molten reactant metal. Reactor 11 also preferably includes a solids removal system for removing solids which rise to the surface of the molten metal 18; however, the solids removal arrangement is omitted from the figures so as not to obscure the invention in unnecessary detail. Those skilled in the art will appreciate that any suitable arrangement may be employed for removing solid reaction products from the molten metal reactor 11. The invention is not limited to any particular solids removal arrangement.

The embodiment of the invention shown in FIG. 1 also includes a reactant metal input 47 for introducing additional reactant metal or reactant metal components into the system. The reactant metal input 47 includes exterior and interior air lock doors, 48 and 49 respectively, and a pre-heating chamber 50 having a separate burner 23. The separate burner 23 heats the newly introduced metal to a molten state in which it may flow into the heating chamber 22 of the molten metal reactor 11. The illustrated reactant metal input arrangement 47 is shown only for purposes of example and convenience in describing the invention. Any suitable arrangement may be used to add additional reactant metal or reactant metal constituents to the reactor and such alternatives are to be considered equivalents to the illustrated arrangement.

Figure 2:
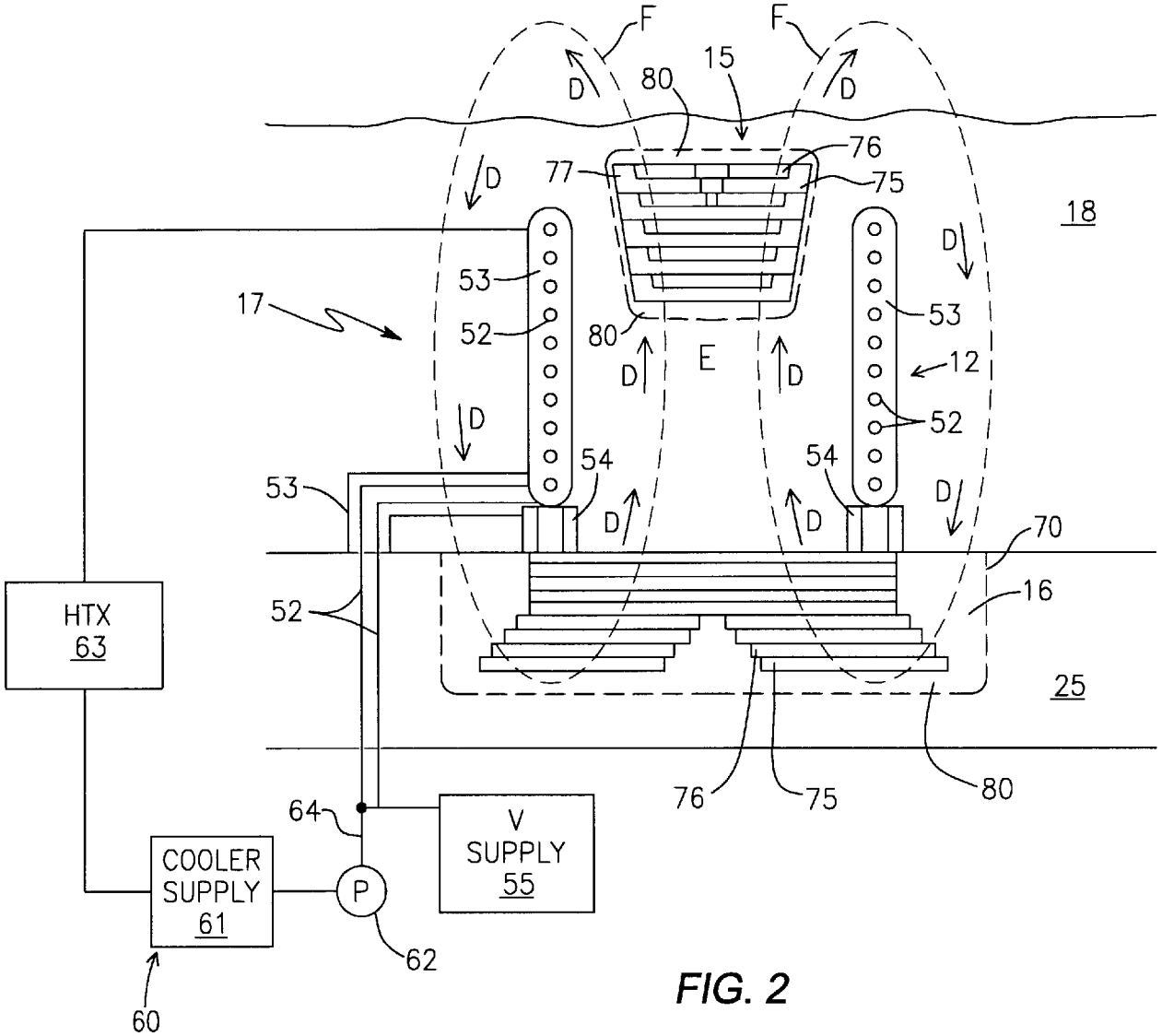
FIG. 2 is a diagrammatic side view of the field generating coils and radiation absorbing modules employed in the apparatus shown in FIG. 1.
Figure 3:
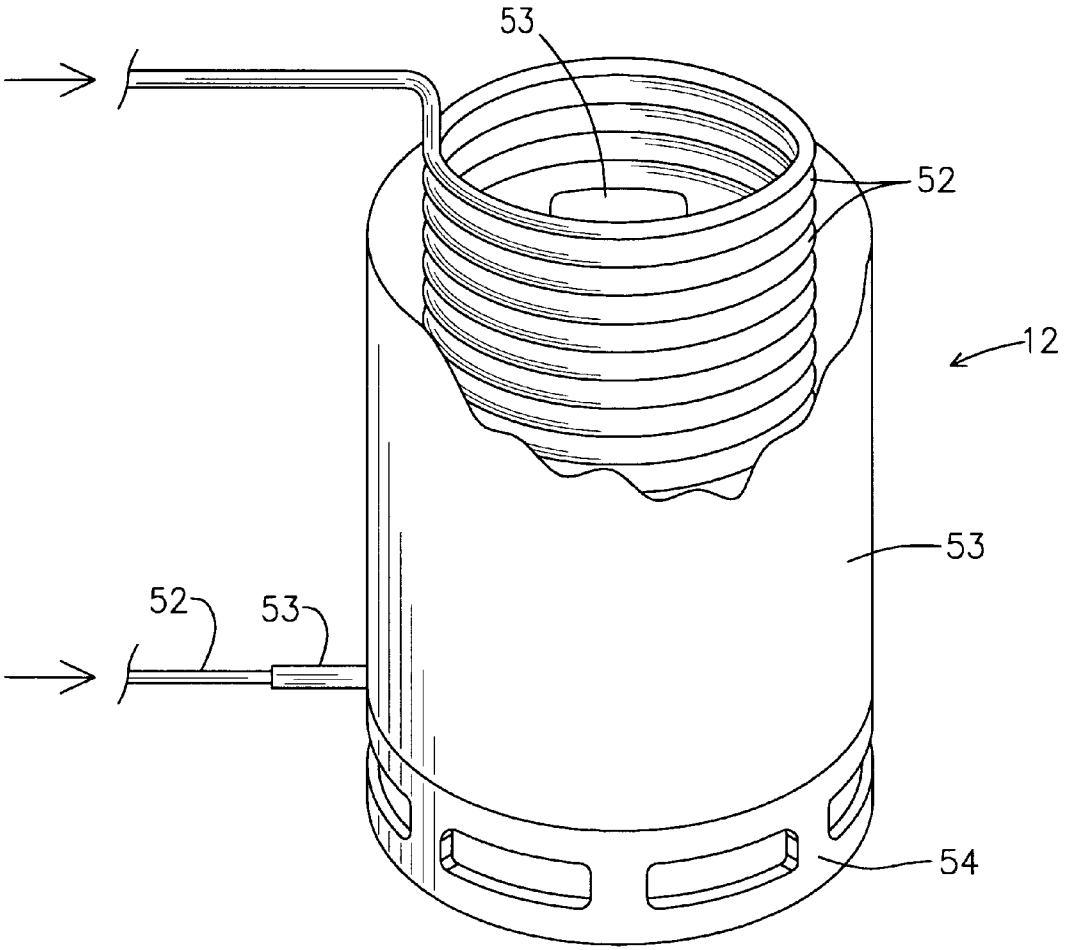
FIG. 3 is a diagrammatic view in perspective of one preferred coil arrangement.

Referring to FIGS. 2 and 3, the field generating arrangement 17 includes the secondary induction coil 12 and a voltage supply 55 for inducing a field generating current through the coil. Voltage supply 55 preferably comprises a step-up transformer for producing a high voltage signal to be applied to secondary induction coil 12. The voltage signal produced by the preferred transformer is rectified by suitable means (not shown) so that current is induced only in a single direction in secondary induction coil 12. This unidirectional current flow through secondary induction coil 12 produces the desired unidirectional electromagnetic field through molten reactant metal 18.

Voltage supply 55 may induce a current on the order of 10,000 amps, for example, through secondary induction coil 12, to produce a very strong electromagnetic field through molten reactant metal 18. Also, the preferred voltage supply 55 applies a pulsed voltage signal to secondary induction coil 12 rather than a continuous voltage signal. The voltage signal may be pulsed at a frequency of between 1 to 30 kHz. The preferred voltage pulse frequency is approximately 10 kHz. Higher frequencies increase the energy applied to the molten reactant metal 18 through the electromagnetic field.

FIG. 3 shows one preferred secondary induction coil 12 made up of a tubular conductor 52 which may be copper for example. In this illustrated form of the invention, coil 12 comprises a single elongated helical coil. Secondary induction coil 12 is fixed on a suitable structure 54 within reactor chamber 20, and the entire coil and associated support structure is encased in a suitable protective material 53 similarly to other metal components of reactor 11. Protective material 53, which may comprise a ceramic material or fused silicate, protects the coil material 52 and its support structure 54 from the molten reactant metal 18 in reactor chamber 20.

It will be appreciated that coil 12 need not be mounted within the reaction chamber 20 itself to apply the desired electromagnetic field. In other forms of the invention, secondary induction coil 12 may be located outside of the reaction chamber. In this form of the invention, the wall of the reaction chamber protects the coil material from the reactant metal alloy. Thus the coil need not be encased in the protective material.

FIGS. 2 and 3 show the induced electromagnetic field having lines of force F in the direction indicated by arrows D. Referring to FIG. 2, module 15 is preferably positioned generally in an area at which the electromagnetic field strength is greatest. In any event, the electromagnetic field traverses both the molten reactant metal 18 and module 15. Negatively charged beta particles emitted in the area of the field are directed or deflected in direction D. The electromagnetic field directs beta particles emitted generally in the area E toward module 15 where the particles may be absorbed by the radiation absorbing material included in the module. Also, the electromagnetic field produces a pumping or circulating effect in the molten reactant metal 18 in the direction of arrows D.

As shown in FIG. 2, field generating arrangement 17 includes a cooling system 60 for cooling each coil 12. The preferred cooling system 60 is similar to systems used to cool the induction coils of an induction furnace and includes a supply 61 of coolant fluid such as water, a suitable pump 62, and a heat exchanger 63. Pump 62 operates to circulate coolant fluid from coolant fluid supply 61 through supply tube 64 and to the tubular conductor 54 from which coil 12 is formed. Heat exchanger 63 cools the coolant fluid after the fluid passes through the coil 12.

Referring to FIGS. 1 and 2, the radiation in absorbing modules 15 and 16 are each positioned in a target area which is traversed by the electromagnetic field. The primary or first radiation absorbing module 15 is positioned in a first target area which preferably comprises an area where the electromagnetic field strength is greatest. In the embodiment of the invention shown in FIG. 1, first radiation absorbing module 15 is mounted on a positioning arrangement 65 for positioning the module at the desired location. Positioning arrangement 65 includes a support 66 and a suitable actuator 67 for moving the module 15 along axis L. The preferred positioning arrangement 65 may also be operable to withdraw first radiation absorbing module 15 from the reaction chamber 20 so that the module may be replaced readily.

The second radiation absorbing module 16 is positioned in a recess 70 formed in the alumina brick floor of reaction chamber 20. This second radiation absorbing module 16 serves to protect the flooring material by absorbing beta emissions which are deflected toward the floor of the chamber by the electromagnetic field.

Each radiation absorbing module 15 and 16 includes at least one radiation absorbing material. The radiation absorbing material absorbs the beta particles emitted from the radioactive waste being treated and also absorbs gamma photons which may be emitted as the beta particles are absorbed. In the preferred form of the invention the radiation absorbing material in each radiation absorbing module 15 and 16 comprises a plurality of layers of tungsten 75 and lead 76. Each layer of tungsten 75 is separated from the adjacent tungsten layer by one of the layers of lead 76. Since lead will go into a molten in state at the preferred temperature of the molten reactant metal 18, each module also preferably includes a spacing arrangement for maintaining the spacing between the tungsten layers 75. The preferred spacing arrangement comprises extension members 77 extending from the tungsten layers 75. The extension members 77 may be integrally formed with the tungsten layers 75 or may be separate pieces of tungsten or other high melting point material. The tungsten 75 and lead 76 layers are preferably at least one millimeter thick and are preferably on the order of about two inches thick. Also, each layer 75 and 76 may comprise a circular disk, although any shape may be employed to provide sufficient radiation absorbing material to safely absorb the predicted beta particle emissions.

Each module 15 and 16 also includes a layer of protective material 80. Protective material 80 protects the radiation absorbing material included in the module (the tungsten 75 and lead 76 in the illustrated embodiment) from direct contact with the molten reactant metal 18. Any suitable ceramic or other material which is substantially transparent to the electromagnetic field may be used as the protective material 80. For example, the protective material 80 may comprise a fused silica material.

The preferred reactant metal 18 includes primarily aluminum and may include relatively small amounts of iron, copper, zinc, and calcium. Alternatively, or in addition to the aluminum, the reactant metal may include magnesium and/or lithium. The reactant metal 18 also preferably includes materials for absorbing alpha, beta, and gamma radiation such as lead and tungsten. Cadmium, palladium, dysprosium, and/or europium may also be included in the reactant metal 18 for absorbing neutrons which may be released from the decaying radioactive material. For example, the reactant metal may include 40–92% aluminum, 1–60% magnesium, 1–50% lithium, 1–30% cadmium, 1–30% palladium, 1–5% dysprosium, 1–3% europium, 1–40% lead, and 1–30% tungsten, all expressed as a percentage by weight. The particular makeup of the reactant metal preferably depends upon the constituents of the incoming waste material. For example, one preferred reactant metal 18 may comprise an alloy containing approximately 60% aluminum, 5% magnesium, 5% lithium, 3% cadmium, 3% palladium, 2% dysprosium, 10% lead, and 10% tungsten, by weight. The only requirements of the reactant metal 18 are that it be capable of rapidly reacting with the organic materials in the waste materials and contain sufficient radiation absorbing materials to absorb a substantial portion of the radioactive emissions during long term storage.

The method according to the invention includes first placing the reactant metal in a molten state and substantially isolating the molten reactant metal 18 from oxygen. These steps may be accomplished with the molten metal reactor 11 shown in FIG. 1. The waste treatment method also includes producing the unidirectional electromagnetic field through the molten reactant metal 18 and through at least one target area such that the electromagnetic field directs negatively charged beta particles toward the target area. With the molten reactant metal 18 in the desired molten state and the electromagnetic field traversing the molt metal, the treatment method further includes introducing the waste material into the molten reactant metal and preferably circulating the molten reactant metal to direct radioactive constituents of the waste material into the area of the molten reactant metal which is traversed by the electromagnetic field.

The radiation absorbing modules 15 and 16, and particularly the first radiation absorbing module 15 intercepts the electromagnetic field in the first target area and also intercepts beta particles which have been directed toward the first target area by the electromagnetic field. Thus the radiation absorbing material in the modules 15 and 16 absorbs the beta radiation without being exposed directly to the radioactive material which is now alloyed with the reactant metal 18. The modules 15 and 16 may be replaced as required to provide fresh radiation absorbing material. The useful life of a particular radiation absorbing module, and thus the replacement time for the module, may be estimated from the mass of the radiation absorbing materials included in the module and the predicted beta particle emissions from radioactive waste materials added to the reactor.

The above described preferred embodiments are intended to illustrate the principles of the invention, but not to limit the scope of the invention. Various other embodiments and modifications to these preferred embodiments may be made by those skilled in the art without departing from the scope of the following claims.

I claim:

1. An apparatus for treating waste materials, the apparatus comprising:

(a) a molten metal reactor including a reaction chamber charged with a reactant metal, and further including a heating arrangement for placing the reactant metal in a molten state;

(b) a waste material input structure through which waste material may be introduced into the reaction chamber to contact the molten reactant metal;

(c) field generating means for generating a unidirectional electromagnetic field through the molten reactant metal and through a first target area, the electromagnetic field directing beta particles toward the first target area; and (d) a first radiation absorbing module positioned in the first target area, the first radiation absorbing module including a radiation absorbing material.

2. The apparatus of claim 1 wherein the field generating means comprises:

(a) a field generating coil; and (b) a voltage supply for directing a field generating electrical current through the field generating coil.

3. The apparatus of claim 2 wherein the field generating current comprises a pulsed current.

4. The apparatus of claim 2 wherein the field generating coil is adapted to be positioned within the molten reactant metal and further comprising:

(a) cooling means for cooling the field generating coil; and (b) a protective material encasing the field generating coil and protecting the coil from the reactant metal.

5. The apparatus of claim 4 wherein:

(a) the field generating coil is made from a tubular conductor; and (b) the cooling means comprises a cooling fluid supply and a pump for directing cooling fluid from the cooling fluid supply through the tubular conductor.

6. The apparatus of claim 1 wherein the reactant metal comprises an alloy including aluminum and further including at least one additional metal chosen from a group consisting of cadmium, palladium, tungsten, lead, dysprosium, and europium.

7. The apparatus of claim 1 further comprising:

(a) a waste material submerging arrangement for submerging the waste material in the molten reactant metal.

8. The apparatus of claim 1 wherein the first target area comprises an area in which the electromagnetic field strength is substantially greatest.

9. The apparatus of claim 1 wherein the first radiation absorbing module comprises:

(a) a plurality of layers of tungsten, each layer of tungsten being separated from each adjacent layer of tungsten by a layer of lead;

(b) a spacing arrangement for maintaining the spacing between the layers of tungsten; and (c) a protective material encasing the tungsten and lead layers to protect the tungsten and lead from the reactant metal.

10. The apparatus of claim 1 further comprising:

(a) a positioning structure for positioning the first radiation absorbing module in the reaction chamber and for selectively withdrawing the first radiation absorbing module from the reaction chamber.

11. The apparatus of claim 1 further comprising:

(a) a second radiation absorbing module positioned in the electromagnetic field at an end of the electromagnetic field opposite to an end in which the first radiation absorbing module is positioned.

12. The apparatus of claim 11 wherein the second radiation absorbing module comprises:

(a) a plurality of layers of tungsten, each layer of tungsten being separated from each adjacent layer of tungsten by a layer of lead;

(b) a spacing arrangement for maintaining the spacing between the layers of tungsten; and (c) a protective material encasing the tungsten and lead layers to protect the tungsten and lead from the reactant metal.

13. A method for treating waste materials, the method comprising the steps of:

(a) placing a reactant metal in a molten state and substantially isolating the molten reactant metal from oxygen;

(b) producing a unidirectional electromagnetic field through the molten reactant metal and through a first target area, the electromagnetic field directing beta particles toward the first target area;

(c) introducing the waste material into the molten reactant metal;

(d) circulating the molten reactant metal to direct constituents of the waste material into the area of the molten reactant metal traversed by the electromagnetic field; and (e) intercepting the electromagnetic field in the first target area with a radiation absorbing material.

14. The method of claim 13 wherein the step of producing the unidirectional electromagnetic field includes:

(a) directing a field generating current through an electrically conductive coil made from a tubular material and positioned in the molten reactant metal, the coil being encased in a protective coating material which protects the coil from the molten reactant metal;

(b) cooling the coil by directing a coolant fluid through the tubular coil material.

15. The method of claim 13 wherein the step of intercepting the electromagnetic field with a radiation absorbing material includes:

(a) intercepting the electromagnetic field with a plurality of layers of tungsten and lead, each layer of tungsten being separated from each adjacent layer of tungsten by a layer of lead.

16. The method of claim 13 wherein the first target area is located within the reactant metal bath and further comprising the step of protecting the radiation absorbing material from the reactant metal with a protective coating material.

17. The method of claim 13 further comprising the step of:

(a) intercepting the electromagnetic field with a radiation absorbing material in a second target area traversed by the electromagnetic field.

* * * * *

UNITED STATES PATENT AND TRADEMARK OFFICE

CERTIFICATE OF CORRECTION

PATENT NO. : 6,037,517
DATED : March 14, 2000
INVENTOR(S) : Anthony S. Wagner

It is certified that error appears in the above-identified patent and that said Letters Patent is hereby corrected as shown below:

In column 2, line 50 of the Patent, "filed" should be changed to --field--.

In column 3, line 18 of the Patent, after the word "of" insert --the--.

In column 4, line 6 of the Patent, "Reactor" should be changed to --Reaction--.

In column 4, line 65 of the Patent, "and" should be changed to --in--.

In column 5, line 16 of the Patent, "an" should be changed to --in--.

In column 6, line 28 of the Patent, "Figures 2 and 3 show" should be changed to --Figure 2 shows--.

In column 6, line 49 of the Patent, change "54" to --52--.

In column 6, line 52 of the Patent, delete the word "in".

In column 7, line 15 of the Patent, delete the word "in".

In column 8, line 7 of the Patent, "molt" should be changed to --molten--.

Signed and Sealed this

Sixth Day of February, 2001

*Attest:*

*Attesting Officer*

Q. TODD DICKINSON

*Director of Patents and Trademarks*